US006715710B1

(12) United States Patent
Russell et al.

(10) Patent No.: US 6,715,710 B1
(45) Date of Patent: Apr. 6, 2004

(54) SELF ALIGNING STACKABLE CABLE REEL

(75) Inventors: Kelly C. Russell, Hartselle, AL (US); Randall S. Wilson, Decatur, AL (US); Robert D. White, Hartselle, AL (US)

(73) Assignee: Russell Forest Products, Inc., Hartselle, AL (US)

( * ) Notice: Subject to any disclaimer, the term of this patent is extended or adjusted under 35 U.S.C. 154(b) by 0 days.

(21) Appl. No.: 10/242,817

(22) Filed: Sep. 13, 2002

(51) Int. Cl.[7] ..... B65H 75/14; B65H 75/18
(52) U.S. Cl. ..... 242/605; 242/614
(58) Field of Search ..... 242/605, 614, 242/614.1, 118.4, 118.41, 611.1

(56) References Cited

U.S. PATENT DOCUMENTS 2,965,057 A * 12/1960 Lakin ..... 242/118.4
3,508,719 A * 4/1970 Browning ..... 242/605
4,602,752 A 7/1986 Nimke et al. ..... 242/129
5,354,008 A * 10/1994 Honegger ..... 242/605
5,421,537 A * 6/1995 Cobane et al. ..... 242/605
5,605,305 A 2/1997 Picton ..... 242/608
5,622,333 A 4/1997 Jacques ..... 242/578.2
5,720,397 A 2/1998 Thompson ..... 211/59.4
5,897,075 A * 4/1999 Elder et al. ..... 242/605

* cited by examiner

*Primary Examiner*—John M. Jillions
(74) *Attorney, Agent, or Firm*—Womble Carlyle Sandridge & Rice PLLC

(57) ABSTRACT

A self-aligning stackable cable reel has a pair of spaced apart disc-shaped flanges joined by a tubular central core. Each flange has a periphery and an outside face. A generally annular rim extends around the periphery of each flange and projects outwardly from the outside face to an edge. The edge of each rim is contoured to define a repeating serpentine pattern around the rim. When two cable reels are stacked end-on-end, the serpentine patterns of their respective rims intermesh to align the cable reels automatically with each other and to lock them against relative sliding motion during transport.

15 Claims, 3 Drawing Sheets

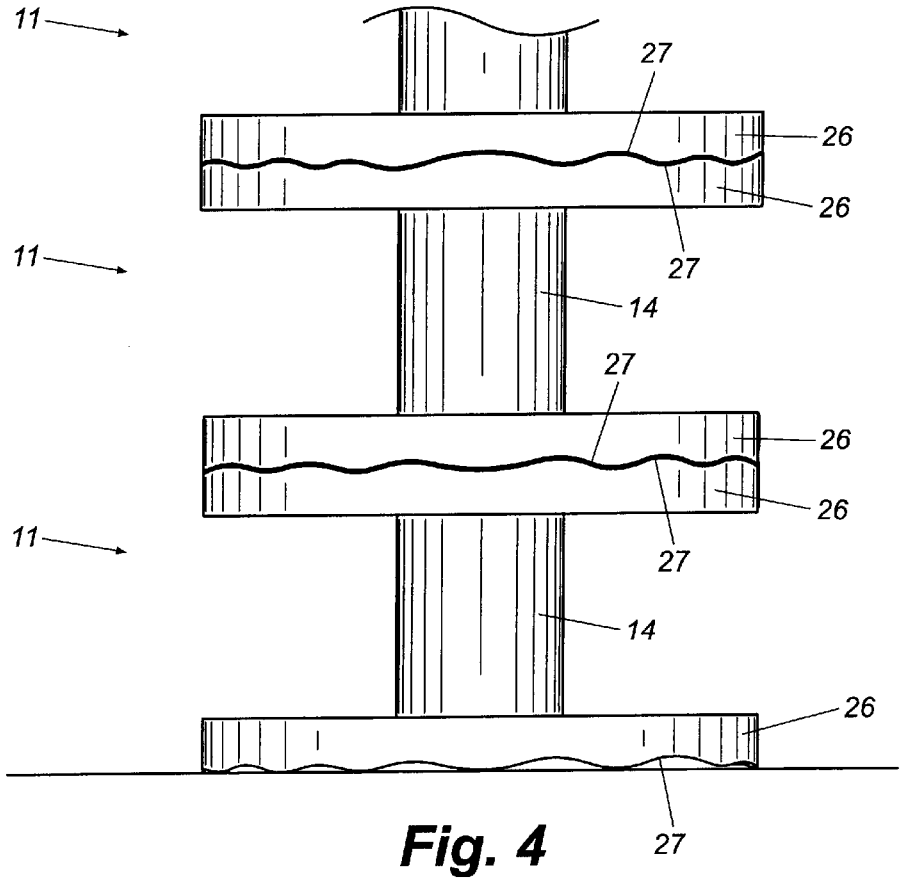
Fig. 4
Fig. 5a
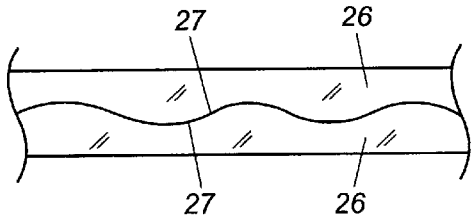
Fig. 5b
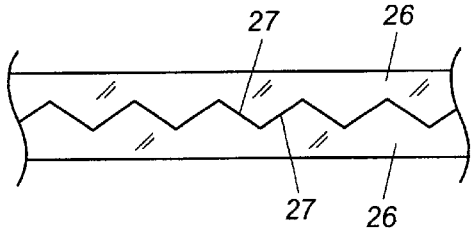
Fig. 5c
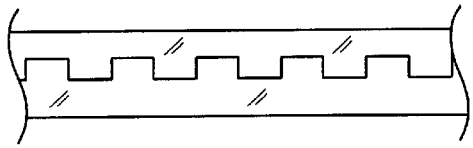

SELF ALIGNING STACKABLE CABLE REEL

TECHNICAL FIELD

This invention relates generally to cable reels and more specifically to the stacking of cable reels for storage and transport.

BACKGROUND

Cable reels have long been used for transporting and storing bulk wire and cable such as telecommunications cable, electrical wire, bailing wire, wire rope, and the like. A typical cable reel is formed with a pair of spaced apart disc-shaped flanges joined by a central tubular core. Wire or cable is spirally wound around the central core between the spaced flanges until the reel is filled. Filled reels can then be stacked atop one another for shipment and storage. When it is desired to remove the wire or cable from the reel for use, it is simply pulled progressively from the reel, which may be mounted on an arbor or spindle to rotate and thus pay out the wire or cable. If only a portion of the wire or cable is used, the free end of the remaining portion may be secured to one of the flanges of the reel, whereupon the reel can be stored until future use. A variety of U.S. patents illustrate these types of cable reels, including U.S. Pat. No. 5,605,305 of Picton, U.S. Pat. No. 5,662,333 of Jacques, and others.

Cable reels of the type discussed above are simple in basic configuration yet function exceptionally well for storing large amounts of wire or cable in a compact space. Nevertheless, the efficient and effective stacking of cable reels atop one another for transport or storage has long presented a challenge to cable and wire manufacturers and users for a variety of reasons. This is particularly true for mid-sized and larger reels, which can be exceedingly heavy when filled with wire or cable. Cable reels usually are stacked for transport or storage by upending the reels and stacking them in an end-on-end relationship with the flange of one reel resting on the flange of the reel beneath. When so stacked, the reels must be aligned with one another to form neat and efficient stacks and must be secured so that one reel does not slide off of the reel beneath it when the stack is transported. Aligning the reels in a stack often is done manually or with tools such as fork lifts. Securing the reels against sliding may be accomplished by lashing the reels down or to one another, securing them to each other with fasteners, or wrapping several stacks in, for instance, a plastic wrap atop a pallet. Such brute force techniques of stacking, aligning, and securing cable reels is time and energy consuming, inefficient, and does not always work satisfactorily.

Attempts have been made to improve upon the traditional storage and transport of cable reels. For instance, U.S. Pat. No. 5,720,397 of Thompson discloses a reel rack made of metal that is suited for use in the storage and transporting of reels of wire or cable. The reel rack disclosed in Thompson is a metal rack designed to support a number of cable reels in their normal, i.e. not upended, orientations in a manner similar to the way an egg crate supports eggs. Loaded reel racks may be stacked atop one another for storing or transporting the reels. Problems with such a solution include the fact that a large number of the auxiliary metal reel racks, which are heavy and bulky, must be stored and maintained. Further, stacking cable reels in this way wastes significant space compared to stacking them end-on-end such that fewer reels can be stored in a given space as compared to end-on-end stacking.

Accordingly, a need exists for an improved cable reel designed so that a plurality of such reels can be stacked atop one another end-on-end without requiring tedious and time consuming alignment and securing of the individual reels in the stack. The reels should be substantially self aligning when stacked and should not slip or slide on reels beneath them in the stack, all without the requirement for elaborate lashing or securing techniques or ancillary fasteners. It is to the provision of such a cable reel that the present invention is primarily directed.

SUMMARY OF THE INVENTION

Briefly described, the present invention, in one preferred embodiment thereof, comprises a cable reel having a pair of spaced apart disc-shaped flanges between which a tubular central core extends. The flanges preferably are made of injection molded plastic and include standard cable reel features such as start holes, a dog hole, tie holes, and a central arbor hole. A circular core groove is formed in the inside faces of the flanges for receiving, locating, and securing the ends of the core and bolt holes are provided for bolting the components of the assembled reel together securely. Each flange of the cable reel has an upstanding peripheral rim that has an exposed edge extending around and facing away from the outside face of the flange. The exposed edge of each rim is contoured or shaped to define a repeating wave-like or serpentine pattern that extends around the flange. When one cable reel is upended and stacked atop another cable reel with a flange of the top reel resting on the flange of the bottom reel, the serpentine edges of the rims of each reel intermesh and lock with each other. The intermeshing of the serpentine edges causes the upper reel to align itself automatically and precisely with the lower reel. At the same time, the intermeshed edges, in conjunction with the often substantial weight of the upper reel, locks the two reels together such that the upper reel is prevented from sliding off of the lower reel during transport. Since the two stacked reels are aligned and securely locked together by their intermeshed serpentine edges, no auxiliary straps, fasteners, or other means of securing the reels together are required. Accordingly, when it is desired to remove reels from a stack of reels, they need only be lifted from the stack without the need to remove ancillary fasteners.

Thus, an improved cable reel is now provided that successfully addresses the problems and shortcomings of the prior art. Reels of this invention are self-aligning and self locking when stacked one atop another by virtue of their intermeshing and interlocking serpentine edges, yet are easily unstacked simply by lifting reels from the stack. These and other features, objects, and advantages of the cable reel of this invention will become more apparent upon review of the detailed description set forth below, when taken in conjunction with the accompanying drawing figures, which are briefly described as follows.

BRIEF DESCRIPTION OF THE DRAWINGS

FIG. 4 is a side elevational view of a stack of cable reels of the invention illustrating more clearly the intermeshing of the serpentine rim edges to align the reels with one another and secure them against slippage.

FIGS. 5*a*–5*c* are side elevational views of a portion of the flanges of stacked reels illustrating alternate shapes of the rim edges.

DETAILED DESCRIPTION OF THE PREFERRED EMBODIMENTS

Figure 1:
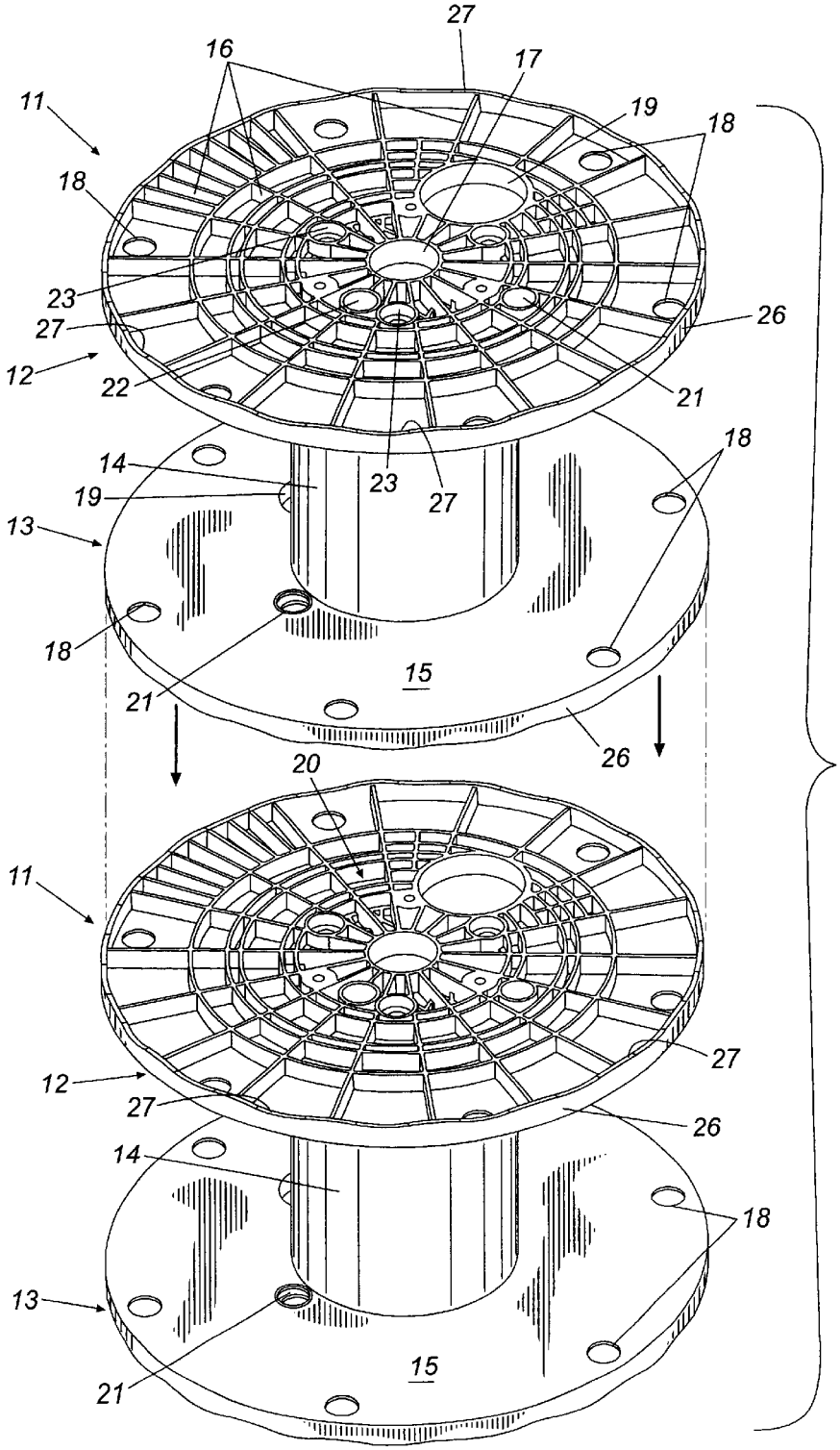
FIG. 1 is a perspective partially exploded view showing a pair of cable reels that embody principles of the present invention in position to be stacked end-on-end for storage or transfer.

Referring now in more detail to the drawing figures, in which like reference numerals refer to like parts throughout the several views, FIG. 1 illustrates a pair of cable reels that embody principles of the present invention in a preferred form. The reels, which are identical, are shown poised to be stacked end-on-end atop one another according to the methodology of the invention. The flanges of the reels preferably are made of injection molded plastic, although other equivalent materials and constructions might be selected.

Each cable reel 11 comprises first and second spaced apart generally disc-shaped flanges 12 and 13 respectively joined by a tubular central hub or core 14. The flanges 12 and 13 have inside face portions 15 that face each other and outside face portions 20 that face away from each other. In the illustrated embodiment, the inside face portions 15 of the flanges are substantially smooth and flat. In contrast, the outside face portions 20 of the flanges are formed with an array of support ribs 16, which provide rigidity and support to the flange while conserving plastic. The array of support ribs in the illustrated embodiment includes radially extending support ribs intersected by concentric circular support ribs; however, the particular rib pattern and structure is not a limitation of the invention and other equivalent rib structures might be chosen.

Each flange in the illustrated embodiment is formed with a number of features commonly found in cable reels for supporting the use of the reels. For instance, the flanges each have a large start hole 19 and a small start hole 21 through which an end of a wire or cable may be inserted to hold the end in place while the wire or cable is wound onto the reel. A central arbor hole 17 is provided for mounting the reel on an arbor or spindle as it is being wound with wire or cable. A dog hole 22 is radially spaced from the central arbor hole to accommodate the winding dogs of a winding machine used to fill the reels with wire or cable. An array of tie holes 18 are formed around the peripheral portion of each reel for receiving the cut end of a wire or cable wound onto the reel to secure the cut end and prevent the reel from unraveling unintentionally. While the various holes and features in the illustrated embodiment are common in mid-size cable reels, they should not be considered a limitation of the invention, but only as illustrating an example reel and the best mode known to the inventors of carrying out the invention.

An upstanding or outwardly projecting rim 26 is formed around the perimeter of each flange and is intersected and thereby strengthened and supported by the radial extending ribs 16 of the support rib structure. The peripheral rim 26 preferably projects a distance slightly greater that the height of the ribs 16 to a generally annular or circular outer edge 27, which faces away from the outside face 20 of the flange. The outer edge 27 of each rim is not flat, but rather is contoured such that the edge takes on a wavy, sinusoidal, or serpentine shape as viewed from the edge of the flange. The serpentine edges 27 of the flange rims 26 are identical such that when two flanges are stacked atop each other, as indicated by the arrows in FIG. 1, the edges of their respective flange rims intermesh together, the peaks of one edge nestling in the troughs of the other edge. When two reels are stacked with their edges meshed in this way, the intermeshed edges on their upstanding rims function to align the two flanges and thus to align the reels precisely with each other.

In addition to aligning stacked reels, the intermeshed rim edges prevent the upper reel from sliding or moving atop the reel below so long as the edges are intermeshed together as described. In this regard, the reels can be quite heavy when fully loaded with wire or cable and this weight holds the meshed edges of stacked reels securely together, effectively interlocking them such that the stacked reels are prevented from sliding with respect to each other. Therefore, not only are the reels self aligning, they are also self interlocking to prevent slippage and movement of the reels with respect to each other, particular during transport. Nevertheless, when it is desired to remove reels from a stack of reels, they need only be lifted upwardly from the stack since no ancillary restraints or fasteners are used to secure adjacent reels in the stack together.

Figure 2:
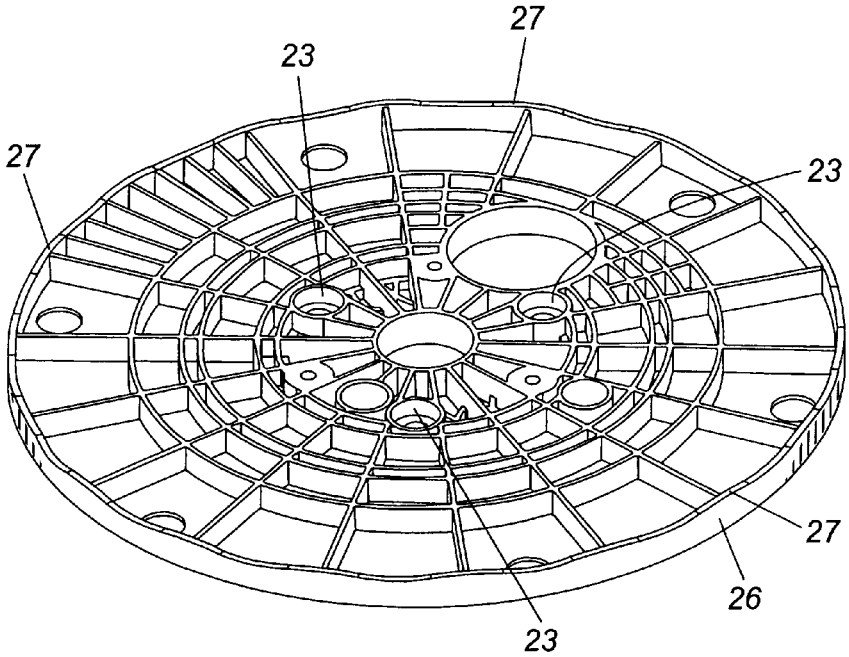
FIG. 2 is a perspective view of the outside face of a flange of the cable reel of this invention.
Figure 3:
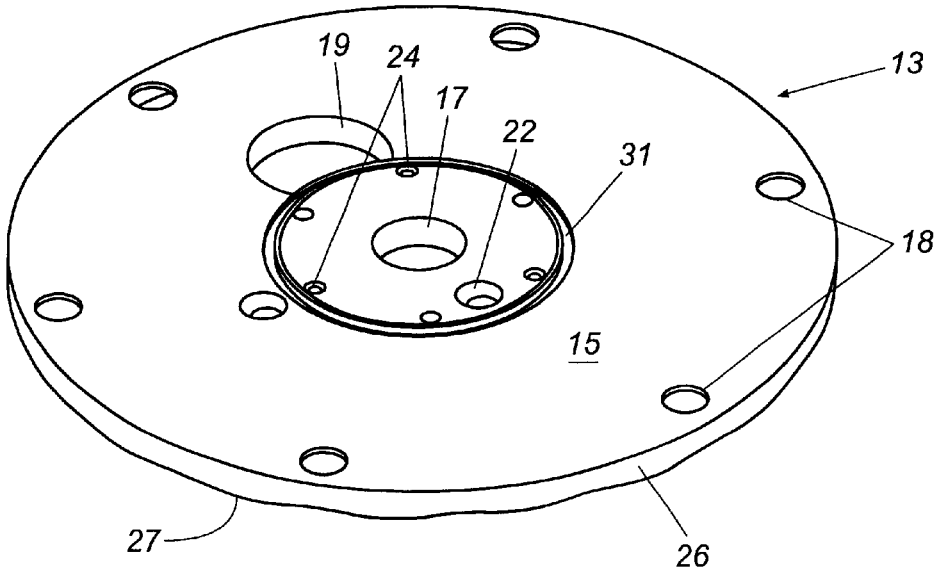
FIG. 3 is a perspective view of the inside face of a flange of the cable reel of this invention.

FIGS. 2 and 3 illustrate the flanges of the cable reel removed from their central core. In FIG. 2, the support rib pattern on the outside face of the flange is clearly visible as are the various holes used when filling the reel with wire or cable. Also clearly shown in FIG. 2 is the upstanding peripheral rim 26 of the flange and its serpentine outwardly facing edge 27. Referring to FIG. 3, the inside face 15 of each flange is formed with an annular core groove 31 that is sized and shaped to receive, position, and secure the end of the core 14 for assembling the reel. Screw holes 24 are formed around and just inside the core groove for threadably receiving screws that extend through the screw bosses 23 of the opposing flange and through the interior of the core 14 for holding the cable reel securely together. The upstanding rim 26 and outwardly facing serpentine edge 27 of the flange 13 also is visible in FIG. 3.

FIG. 4 illustrates in slightly exaggerated form how the serpentine edges of the cable reels intermesh to align and secure a stack of reels according to the invention. Several cable reels 11 are shown stacked-end-on-end atop one another in a stack. It will be understood that in most cases, the reels will be filled with wire or cable when so stacked. However, the reels are shown without wire or cable in FIG. 4 for clarity and ease of description. The outwardly facing edges 27 of the peripheral rims 26 are seen to be intermeshed with each other as described above with the hills of one edge being nestled in the troughs of the other edge. It can be better appreciated from this drawing that this intermeshing of the rim edges functions to align the stacked cable reels with each other and to interlock reels in the stack with reels beneath them so that none of the reels in the stack can slide or otherwise move on the reel below.

While the best mode of carrying out the invention is considered by the inventors to be a reel with a serpentine rim edge as illustrated in FIGS. 1 through 4, shapes other than serpentine might be chosen with comparable results. FIGS. 5*a* through 5*c* each illustrates a section of the rims of stacked reels exhibiting some possible edge configurations. FIG. 5*a* illustrates the serpentine edge shape of the preferred embodiment discussed above. FIG. 5*b* illustrates an alternate edge configuration wherein the edges of the upstanding rims are formed with a saw tooth shape and wherein the tips of the saw teeth of one rim nestle in the valleys of the saw teeth of the other rim. FIG. 5*c* illustrates yet another possible configuration wherein the rim edges are formed with square or rectangular teeth that intermesh with each other when reels are stacked. These and other configurations of the outwardly facing rims are possible and all should be considered equivalent to the serpentine shape of the preferred embodiment and within the scope of the invention.

The invention has been described herein in terms of preferred embodiments and methodologies considered to be the best mode of carrying out the invention. It will be understood, however, that various additions, deletions, and modifications to the illustrated embodiments might be made by those of skill in the art without departing from the spirit and scope of the invention as set forth in the claims.

What is claimed is:

1. A self-aligning and self-securing stackable cable reel comprising:

a core having ends;

a first flange on one end of said core, said first flange having an inside face, an outside face, and a peripheral portion;

a second flange on the other end of said core, said second flange having an inside face, an outside face, and a peripheral portion; and a structure extending around said peripheral portions of said first and second flanges, each said structure being shaped to intermesh with the same structure on a flange of another one of said cable reels such that cable reels can be stacked end-on-end with said structures mutually intermeshing to align the reels with each other and secure the reels against relative sliding motion.

2. A self-aligning and self-securing stackable cable reel as claimed in claim 1 and wherein said structure extending around said peripheral portions of said first and second flanges comprises an upstanding rim extending around the periphery of said flanges, said upstanding rim having an edge configured to intermesh with an edge of a like cable reel when the reels are stacked end-on-end.

3. A self-aligning and self-securing stackable cable reel as claimed in claim 2 and wherein said edges of said rims are formed with a substantially serpentine shape, the hills of one edge nestling in the troughs of another edge to intermesh said edges together.

4. A self-aligning and self-securing stackable cable reel as claimed in claim 2 and wherein said edges of said rims are formed with a substantially saw tooth shape, the tips of one edge nestling in the troughs of another edge to intermesh said edges together.

5. A self-aligning and self-securing stackable cable reel as claimed in claim 2 and wherein said edges of said rims are formed with a substantially rectangular tooth shape, the teeth of one edge nestling in the spaces between teeth of another edge to intermesh the edges together.

6. A self-aligning and self-securing stackable cable reel as claimed in claim 1 and wherein said first and second flanges are formed of injection molded plastic.

7. A cable reel designed to be stacked end-on-end with like cable reels, said cable reel comprising a pair of spaced apart generally disc-shaped flanges having peripheral edges, inside faces, and outside faces, a central core extending between and joining said flanges for receiving cable to be wrapped on said cable reel, and a structure formed around said peripheral edges of said flanges on said outside faces thereof, said structure being configured to intermesh with like structures on like cable reels when said reels are stacked end-on-end to align said reels with each other and inhibit relative sliding motion of one reel relative to an adjacent reel.

8. A cable reel as claimed in claim 7 and wherein said structure includes a rim.

9. A cable reel as claimed in claim 8 and wherein said rim projects from said outside faces of said flanges to an edge, said edge configured to intermesh with like edges of like cable reels when the reels are stacked end-on-end.

10. A cable reel as claimed in claim 9 and wherein said edges of said rims are formed with a repeating serpentine pattern.

11. A cable reel as claimed in claim 9 and wherein said edges of said rims are formed with a repeating saw tooth pattern.

12. A cable reel as claimed in claim 9 and wherein said edges of said rims are formed with a repeating square tooth pattern.

13. A method of aligning and securing cable reels that are stacked end-on-end for storage and transport, said method comprising forming a structure around the periphery of the cable reel flanges with the structures of the flanges being shaped to intermesh with each other when one cable reel is stacked atop a like cable reel, the structure being a peripheral rim having an irregular edge shaped to intermesh with the irregular edge of the rim of a like cable reel, and wherein the irregular edge is serpentine shaped.

14. A method of aligning and securing cable reels that are stacked end-on-end for storage and transport, said method comprising forming a structure around the periphery of the cable reel flanges with the structures of the flanges being shaped to intermesh with each other when one cable reel is stacked atop a like cable reel, the structure being a peripheral rim having an irregular edge shaped to intermesh with the irregular edge of the rim of a like cable reel, and wherein the irregular edge is saw tooth shaped.

15. A method of aligning and securing cable reels that are stacked end-on-end for storage and transport, said method comprising forming a structure around the periphery of the cable reel flanges with the structures of the flanges being shaped to intermesh with each other when one cable reel is stacked atop a like cable reel, the structure being a peripheral rim having an irregular edge shaped to intermesh with the irregular edge of the rim of a like cable reel, and wherein the irregular edge is square tooth shaped.

* * * * *